United States Patent [19]

Markham

[11] Patent Number: 4,662,700

[45] Date of Patent: May 5, 1987

[54] METAL BACKSHELL AND METHOD OF ASSEMBLING SAME

[76] Inventor: Richard A. Markham, 203 Shore Dr. #8, Winthrop, Mass. 02152

[21] Appl. No.: 824,513

[22] Filed: Jan. 31, 1986

[51] Int. Cl.[4] ..... H01R 13/658

[52] U.S. Cl. ..... 339/143 R; 29/857; 29/866; 339/14 R

[58] Field of Search ..... 29/857, 865, 866; 339/14 R, 143 R, 136 M, 137, 142

[56] References Cited

U.S. PATENT DOCUMENTS

| | | | |
|---|---|---|---|
| 3,744,128 | 7/1973 | Fisher et al. | 339/143 R |
| 3,977,755 | 8/1976 | Edel et al. | 339/143 R |
| 4,420,201 | 12/1983 | Stephenson | 339/143 R |
| 4,457,576 | 7/1984 | Cosmos et al. | 339/143 R |
| 4,497,533 | 2/1985 | Genova et al. | 339/143 R |
| 4,508,414 | 4/1985 | Kusui et al. | 339/143 R |
| 4,514,029 | 4/1985 | Lax et al. | 339/143 R |

*Primary Examiner*—John McQuade

[57] ABSTRACT

A metal backshell for shielding electrical connectors terminating fully shielded, round conductor, flat ribbon cable. The backshell is comprised of a single-piece, metal shell which is snugly fitted over the electrical connector. The back end of the backshell is arranged so that it slides between the cable shield and cable. The front end of the shell extends to the face of a female connector, and on a male connector extends about and to the length of the pin field. When mated, the male backshell fits tightly around and over the female backshell to the length of the inserted pins.

13 Claims, 4 Drawing Figures

METAL BACKSHELL AND METHOD OF ASSEMBLING SAME

FIELD OF THE INVENTION

The present invention relates to shielding for electrical connectors terminating multiple conductors, and more particularly to a new metal backshell and method of using same on electrical connectors terminating fully shielded, round conductor, flat ribbon cable containing multiple conductors.

BACKGROUND OF THE INVENTION

Ribbon-like flexible flat cable comprising a plurality of individual, round conductors embedded in a suitable dielectric medium has attained increased popularity for use in low and high frequency signal transmission applications due to the compactness and flexibility of such structure. However, as the frequency of signal transmissions increases, the signals electromagnetically emanate beyond the confines of their individual conductors to other conductors creating cross-interference problems. To alleviate this problem, the ribbon cable is often encased within a metal sheath of foil or braided metal, and the cable and metal sheath then enclosed within an insulating jacket. The cable conductors are typically terminated in some type of plastic, or similar material, connector. The wire connections, as well as the connector terminals, must also be shielded to prevent electromagnetic emanations. This is usually accomplished by providing a shielding assembly enclosing the connector and the wire connections.

Heretofore, the assemblies used for shielding connectors terminating fully shielded cable have been bulky, difficult to install, generally require excessive cable preparation, and often provide poor 360° shielding across mating male and female connectors. The prior art includes various patents pertaining to shielded electrical connectors. U.S. Pat. No. 4,420,201 to B. D. Stephenson discloses a shielding assembly for enclosing an electrical connector terminating fully shielded cable. The assembly comes in two halves, each with cable shield engaging portions formed in T-shapes. A crimping die is used to connect the T-shaped extensions to the cable shielding. When the cable shielding is thereby terminated, the two halves are assembled onto the connector. The halves are interconnected with conventional hardware. U.S. Pat. No. 3,977,755 to B. Edel and G. Pierer discloses a screening arrangement for a multipin cable connector by the use of metalic liners. Metalic liners are inserted into two halves of a synthetic housing which enclose the connector.

SUMMARY OF THE INVENTION

The present invention is comprised of a single-piece, metal shell which is snugly fitted over an electrical connector terminating fully shielded, round conductor, flat ribbon cable. The back end of the shell is arranged so that it slides between the cable shield and the cable. On female connectors, the shield is flush with the pin sockets. On male connectors, the shell extends about and to the length of the pin field. When mated, the male shell fits tightly around and over the female shell to the length of the inserted pins. 360° metal shielding from cable to cable across the mating connectors is thereby provided.

The present invention is distinguishable from the Stephenson patent in that Stephenson does not provide 360° shielding across the mating connectors. Stephenson requires an independent ground, while the present invention grounds to the mating connector and to each of the mating cable shields. Stephenson has two halves for each connector and is complicated to install. The present invention comes in one piece and is merely slid over the connector. The present invention is also distinguishable from the Edel patent in that Edel does not appear to provide 360° shielding about the connector. Edel also has two halves for each connector and appears to be quite complex in assembling.

Various advantages and features of novelty which characterize the present invention are pointed out with particularity in the claims annexed hereto and forming a part hereof. However, for a better understanding of the invention, its advantages, and objects obtained by its use, reference should be had to the drawings, which form a further part hereof, and to the accompanying descriptive matter, in which there is illustrated and described a preferred embodiment of the invention.

DETAILED DESCRIPTION OF THE PREFERRED EMBODIMENT

Figure 1:
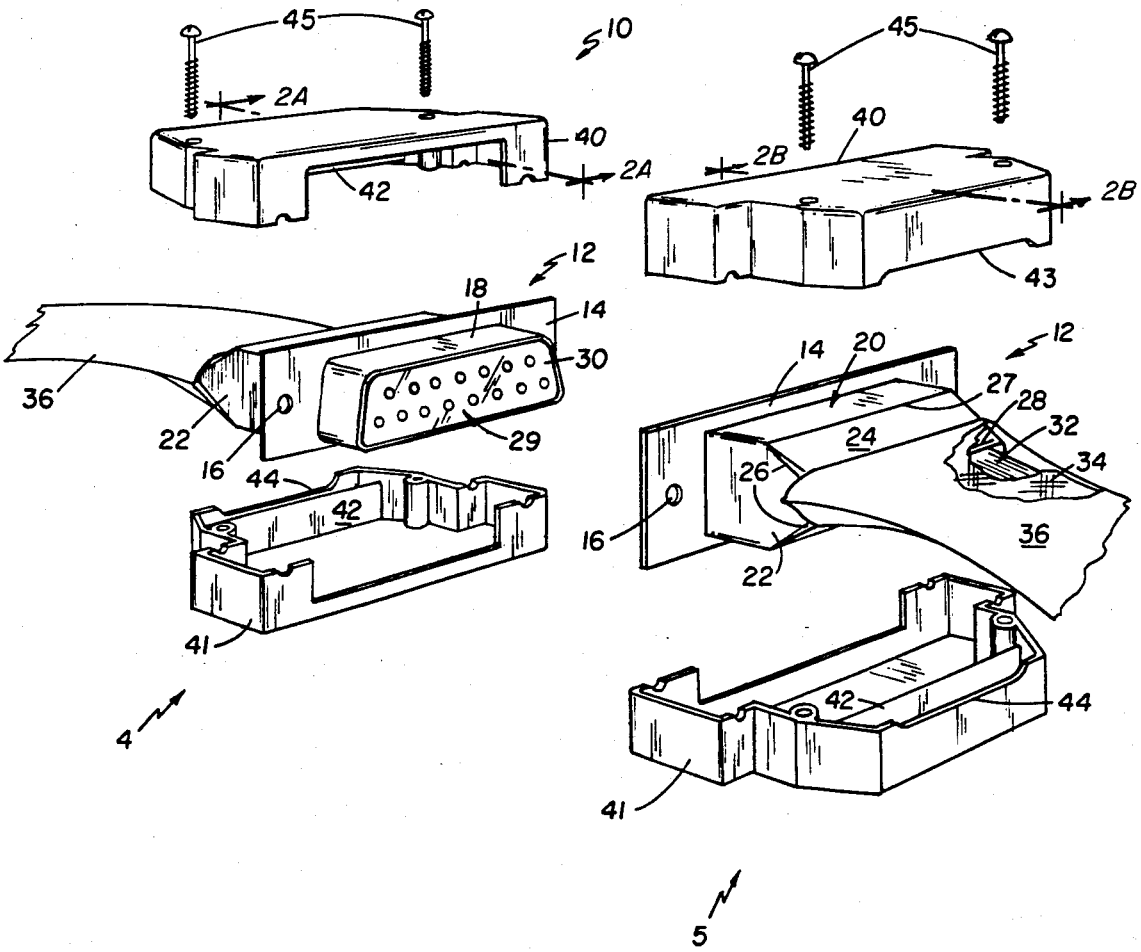
FIG. 1 is a perspective view of a female and a male connector and corresponding shielded flat ribbon cables, with metal backshells installed, connectors unmated, and junction shells exploded.
Figure 2A:
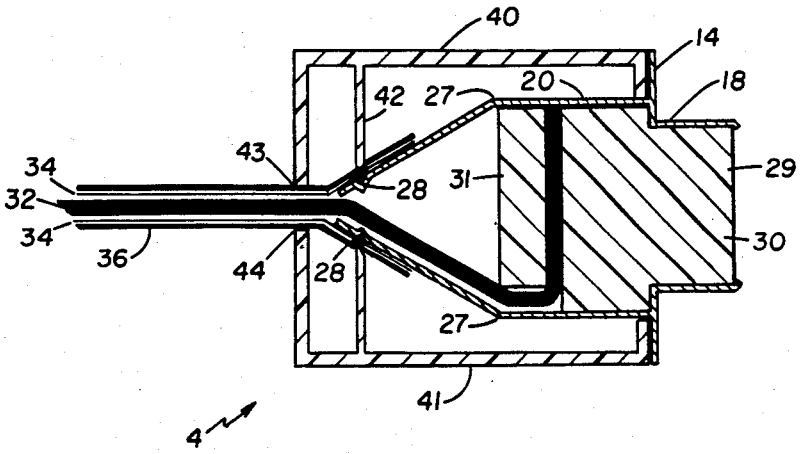
FIG. 2A and 2B contain vertical cross-sectional views of the female connector and, the front portion of the male connector along the lines 2A—2A and 2B—2B respectively of FIG. 1.
Figure 2B:
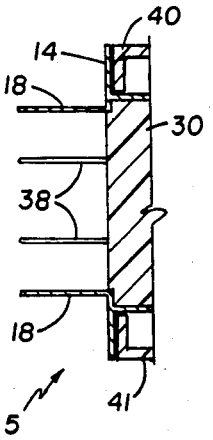

Referring to the drawings in detail, wherein like numerals indicate like elements, there is shown in FIGS. 1 and 2 female 4 and male 5 connector assemblies with backshells 12 installed. The connector assemblies 4 and 5 are unmated and each are terminating flat ribbon cables 32 encased within a metal sheath 34 and enclosed within a flexible, insulating jacket 36. Shown in detail about the connectors 4 and 5 are conventional junction shells 40 and 41. The connectors shown consist of standard "D" type precursers 30 with backshells 12 fitted snugly over them. Each of the backshells 12 cover the entire precurser 30, except the pin and socket faces, to and including a portion of the cable 32 beneath the cable shielding 34.

Shown also is a vertical cross-sectional view at the line marked 2A—2A on the female connector assembly 4. Also visible is a cross-sectional view of the front portion of the male connector assembly 5 at the line 2B—2B. The junction shells 40 and 41 are shown in position over the backshells 12 and precursers 30 in FIG. 2.

As can be seen, the backshells 12 have a flange 14 with two screw holes 16. This enables two mating connectors with backshells to be held securely to each other. The portion of the backshell 12 in front 18 of the flange 14 extends flush to the end of the socket holes 29 in the precurser 30 in the female connector 4, and about and to the length of the pin field 38 for the male connector 5. When mated, the front 18 of the male 5 backshell 12 fits snugly over the front 18 of the female 4 backshell 12 to the length of the inserted pins 38.

The shielded flat cable consists of a ribbon of individual, round conductors imbedded in a dielectric. The ribbon cable 32 has a metalic shield 34, usually a metalic mesh, about it. The ribbon cable 32 and shield 34 is then encased in a flexible jacket 36 usually made of some type of PVC. The ribbon cable 32 is connected to a precurser 30 which has a backshell 12 fitted snugly over it. The backshell 12 tapers down at the precurser's backside 31 to the ribbon cable 32. The cable shielding 34 and housing 36 are positioned up over the backshell's rear 20. The junction shells 40 and 41 are fastened over the backshell 12 and a portion of the cable. The rearward ends 43 and 44 of the junction shells 40 and 41 form a groove which fits over and against the cable jacket 36. This reduces the strain and stress on the cable connections 31 to the precurser 30. The junction shells 40 and 41 each have an inside vertical member 42 rearward and running the width of each shell 40 and 41. When the junction shells 40 and 41 are installed, these members 42 force the cable shielding 34 and jacket 36 into grooves 28 on the rear 20 of the backshell 12 thus preventing slippage of the cable shielding 34 from the rear 20 of the backshell 12. The above arrangement thus provides continuous 360° metalic shielding about the cable 32, across the connectors 30, over the pin field 29 and 38, and to the opposite connector and cable. The junction shells 40 and 41 are held in place with conventional fasteners 45.

Figure 3:
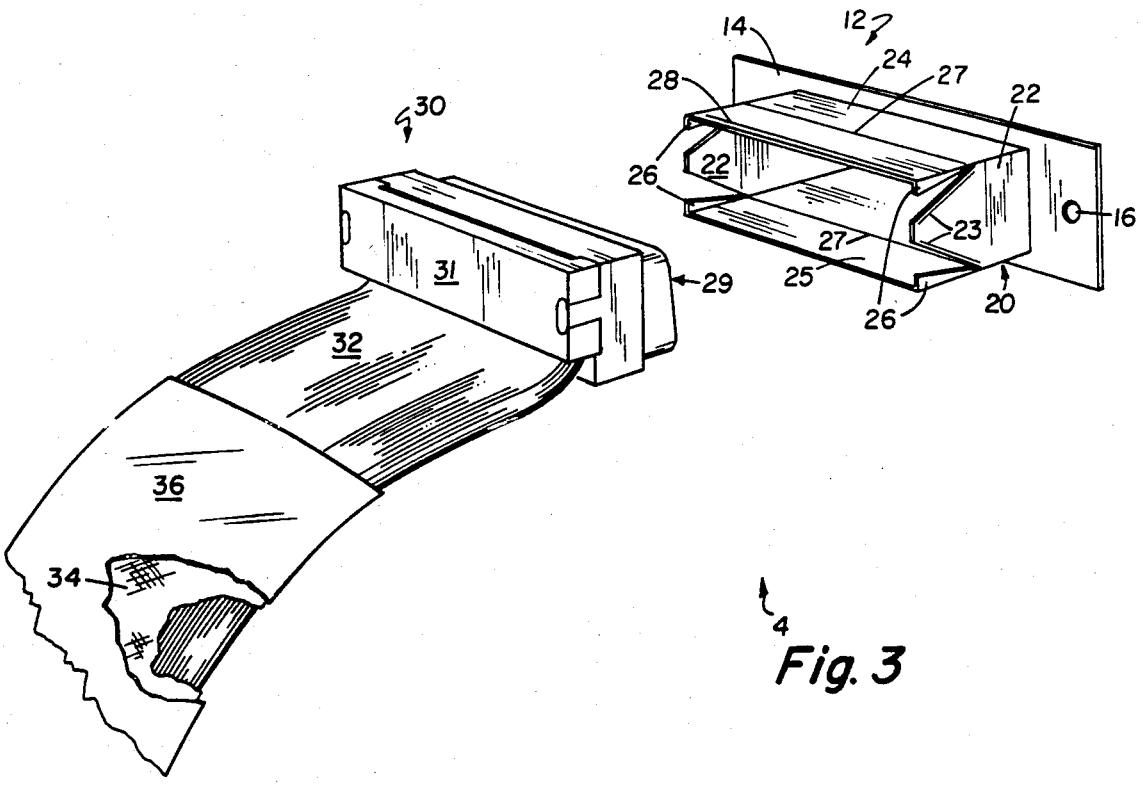
FIG. 3 is an enlarged, rearward perspective view of the female connector and metal backshell shown in FIG. 1 with the backshell separated from the connector.

Prior to installation, the backshell 12 (see FIG. 3) rear 20 is open. The backshell rear 20 has a generally rectangular shape, with top 24 and bottom 25 horizontal members, generally parallel to each other. The vertical sides 22 taper rearwardly, in a vertical plane, to an approximate midpoint. Along the upper and lower outside edges of the tapering sides 22 are slight ridges 23. The horizontal members 24 and 25 have vertical, perpendicular flanges 26 along their rear sides, the upper flanges extending toward the lower ones, and vice versa. Along the width of the horizontal members 24 and 25 at about the middle of the rear 20 portion of the backshell 12 is a bend line 27 formed by scoring the metal. Further rearward and parallel to the bend lines 27 are the grooves 28 described above.

To install the backshell 12, the backshell 12, in an open position, is slid, rear 20 first, over a precurser 30 terminating a shielded, ribbon cable. The cable shielding 34 and jacket 36 are slid back, away from the precurser 30 while the backshell 12 is being slid over the precurser 30. The horizontal members 24 and 25 of the backshell 12 are then bent toward each other along the bend lines 27 until the flanges 26 snap over the ridges 23 on the outer sides 22 of the backshell 12. To increase the positive holding action, the flanges 26 may be scored on their insides corresponding to the ridges 23 on the sides 22. The cable shielding 34 and housing 36 are then slid back and up over a portion of the rear 20 of the backshell 12, at least over the rearward grooves 28. The junction shells 40 and 41 are then fastened into place with the vertical members 42 holding the cable shielding 34 and jacket 36 in place on the backshell rear grooves 28.

It is understood that the above-described embodiment is merely illustrative of the application. Other embodiments may be readily devised by those skilled in the art which will embody the principles of the invention and fall within the spirit and scope thereof.

I claim:

1. A metal backshell for enclosing and shielding an electrical connector terminating fully shielded, round conductor, flat ribbon cable, comprising:

a generally rectangular metal shell defining an enclosure for an electrical connector, having two lesser vertical sides and two greater horizontal sides, having a front section defining an aperture equal to the mating face of said electrical connector, and having a rear section, the two lesser vertical sides of which taper rearwardly, in a vertical plane, to an approximate midpoint, and the two greater horizontal sides of which, each having two side edges and one rear edge, have vertical, perpendicular flanges of rearwardly increasing length along their side edges, the upper and lower flanges extending toward each other, whereby closing said rear horizontal sides upon themselves causes the perpendicular flanges to engage the lesser vertical sides.

2. A metal backshell in accordance with claim 1 further comprising:

an external flange about the exterior of the said metal shell, at its approximate midpoint, in a plane parallel to the front section's aperture and containing two holes, one on either side of the shell's lesser sides.

3. A metal backshell in accordance with claim 2 wherein:

each of the rear greater sides contains an external groove near and parallel to its rear edge.

4. A metal backshell in accordance with claim 3 wherein:

each of the rear greater sides is scored across its width, parallel to its rear edge, at the point where the rear lesser sides begin to taper.

5. A metal backshell in accordance with claim 4 wherein:

each of the rear lesser sides contains a ridge parallel to and nearly at their tapering edges; and each of the rear greater side's vertical flanges are scored on their inside in a line corresponding to the said lesser side edges.

6. A method of enclosing and shielding female and male mated electrical connectors terminating fully shielded, round conductor, flat ribbon cables in which a plurality of conductors arranged in parallel spaced relation are encased within a metalic sheath and enclosed within a flexible, insulating jacket, comprising the steps of:

sliding back a portion of said jacket and said sheath exposing the said conductors for each cable;

terminating each cable's said conductors to their respective female and male electrical connectors;

sliding a pair of generally rectangular metal shells, one defining an enclosure for the female electrical connector and the other defining an enclosure for the male electrical connector, each having two lesser vertical sides and two greater horizontal sides, each having a front section, the one defining an aperture equal to the mating face of said female electrical connect and the other defining an aperture equal to the pin field of said male electrical connector, and each having a rear section, the two lesser sides of which taper rearwardly in a vertical plane to an approximate midpoint and contain ridges parallel to and nearly at their tapering edges, and the two greater sides of which, each having two side edges and one rear edge, and vertical, perpendicular, flanges of rearwardly increasing length along their side edges, the upper and lower flanges extending toward each other, each flange being scored on its inside in a line corresponding to the said rear lesser side ridges, each of the greater sides also being scored across its width parallel to its rear edge at the point where the rear lesser sides begin to taper and each also containing a groove on its external side near and parallel to its rear edge, and each said metal shell also having an external flange about the exterior of the said metal shells at their approximate midpoints in planes parallel to the front section aperture and containing two holes, one on either side of each shell's lesser sides, onto their respective female and male electrical connectors;

closing the rear greater sides of each shell upon themselves until their perpendicular flanges engage the lesser tapered vertical sides;

sliding forward each cable's said sheath and jacket over the grooves on the closed rear horizontal greater sides of each metal shell;

fastening over each metal shell a pair of junction shells, each having a front and rearward end, the rearward ends of each pair of junction shells forming an aperture equal in circumference and shape to that of the said shielded cables, and each junction shell also containing an inside vertical member rearward, parallel to its rearward end, running the width of each junction shell and corresponding to the said grooves on the rear greater sides of the metal shells, so that the junction shells' internal vertical members press a portion of each cable's sheath and jacket into said grooves on the rear greater sides of the metal shells;

joining the metal and junction shell enveloped female and male connectors so that the front portion of the male metal shell fits snugly over the front portion of the female metal shell; and fastening the metal shells and junction shell pairs together by means of fasteners through the holes in the external flanges on the metal shells.

7. An assembly for enclosing and shielding female and male mated electrical connectors terminating fully shielded, round conductor, flat ribbon cable, comprising:

a first, generally rectangular metal shell defining an enclosure for a female electrical connector, having two lesser vertical sides and two greater horizontal sides, having a front section defining an aperture equal to the mating face of said female electrical connector, and having a rear section, the two lesser vertical sides of which taper rearwardly, in a vertical plane, to an approximate midpoint, and the two greater horizontal sides of which, each having two side edges and one rear edge, have vertical, perpendicular flanges of rearwardly increasing length along their side edges, the upper and lower flanges extending toward each other, whereby closing said rear horizontal sides upon themselves causes the perpendicular flanges to engage the lesser vertical sides; and a second, generally rectangular metal shell defining an enclosure for a male electrical connector, having two lesser vertical sides and two greater horizontal sides, having a front section defining an aperture equal to the pin field of said male electrical connector, and having a rear section, the two lesser vertical sides of which taper rearwardly, in a vertical plane, to an approximate midpoint, and the two greater horizontal sides of which, each having two side edges and one rear edge, have vertical, perpendicular flanges of rearwardly increasing length along their side edges, the upper and lower flanges extending toward each other, whereby closing said rear horizontal sides upon themselves causes the perpendicular flanges to engage the lesser vertical sides.

8. An assembly in accordance with claim 7 further comprising:

an external flange about the exterior of each said metal shell, at their approximate midpoints, in a plane parallel to the front sections' apertures, and containing two holes, one on either side of each shell's lesser sides.

9. An assembly in accordance with claim 8 wherein:

each metal shell's rear greater sides contains an external groove on its external side near and parallel to its rear edge.

10. An assembly in accordance with claim 9 wherein:

each metal shell's rear greater sides is scored across its width, parallel to its rear edge, at the point where the rear lesser sides begin to taper.

11. An assembly in accordance with claim 10 wherein:

each metal shell's rear lesser sides contains a ridge parallel to and nearly at their tapering edges; and each metal shell's rear greater side's vertical flanges are scored on their inside in a line corresponding to the said rear lesser side ridges when the greater sides are in a closed position.

12. An assembly in accordance with claim 11 further comprising:

two pairs of junction shells, one pair for each said metal shell, each junction shell having a front and rearward end, the rearward ends of each pair of junction shells forming, when joined, an aperture approximately equal in circumference to the circumference of the shielded cable.

13. An assembly in accordance with claim 12 wherein:

each junction shell contains an inside vertical member rearward, parallel to its rearward end, running the width of each junction shell and corresponding to the said grooves on the rear greater sides of the metal shells.

* * * * *